US005415305A

United States Patent [19]

Drake-Tipton et al.

[11] Patent Number: 5,415,305

[45] Date of Patent: May 16, 1995

[54] INSULATING SLEEVE FOR A BEVERAGE PITCHER

[75] Inventors: Shirley Drake-Tipton; Constance M. Lee, both of Milwaukee, Wis.

[73] Assignee: Miller Brewing Company, Milwaukee, Wis.

[21] Appl. No.: 276,146

[22] Filed: Jul. 18, 1994

[51] Int. Cl.[6] ..... B65D 23/06

[52] U.S. Cl. ..... 215/392; 220/903

[58] Field of Search ..... 215/100 R, 100.5, 12.1, 215/100 A; 220/903, 449

[56] References Cited

U.S. PATENT DOCUMENTS

| | | | |
|---|---|---|---|
| 2,035,384 | 3/1936 | Hinchliff . | |
| 2,482,322 | 9/1949 | Cortese | 220/903 X |
| 3,813,801 | 6/1974 | Vander Schaaf . | |
| 4,268,567 | 5/1981 | Harmony | 220/903 X |
| 4,510,665 | 4/1985 | Scheurer | 215/100.5 X |
| 4,514,995 | 5/1985 | Curtis et al. | 220/903 X |
| 4,871,597 | 10/1989 | Hobson | 215/12.1 X |
| 5,044,515 | 9/1991 | Straub | 215/100.5 X |
| 5,207,076 | 5/1993 | Sciarrillo | 220/903 X |
| 5,251,460 | 10/1993 | DeMarco et al. | 220/903 X |
| 5,299,433 | 4/1994 | Harms et al. . | |

FOREIGN PATENT DOCUMENTS

| | | | |
|---|---|---|---|
| 1269009 | 6/1961 | France | 220/903 |

OTHER PUBLICATIONS

A 1994 Miller Brewing Company advertising entitled "Itsza Wrap . . . " (admitted prior art).

A 1994 Miller Brewing Company flier entitled "Profits In A Way" depicting the 22 oz. bottle wrap with zipper (admitted prior art).

*Primary Examiner*—Allan N. Shoap
*Assistant Examiner*—Christopher J. McDonald
*Attorney, Agent, or Firm*—Quarles & Brady

[57] ABSTRACT

An insulating sleeve for a beverage pitcher is disclosed. The sleeve is a flexible jacket capable of surrounding the pitcher while allowing the pitcher handle to extend out through the side. The jacket also has an open top to permit the pitcher's pour spout to extend out of the top, and an open bottom to permit the base of the pitcher to extend out from the bottom. Advertising messages can be positioned on both the outside and inside of the design, and the sleeve is reversible. The jacket can be formed from a flat piece of material that is generally trapezoidal.

3 Claims, 1 Drawing Sheet

INSULATING SLEEVE FOR A BEVERAGE PITCHER

BACKGROUND OF THE INVENTION

1. Field Of The Invention

The present invention relates to an insulating sleeve for a beverage pitcher.

2. Background Of The Art

It is often desirable to keep a beverage cold outside of a refrigerator, without diluting the beverage with ice. Prior ideas to solve this problem have ranged from providing refrigerant in a separate housing adjacent a beverage container (e.g. U.S. Pat. No. 5,299,433), to providing insulating sleeves (e.g. U.S. Pat. No. 2,035,384 and U.S. Pat. No. 3,813,801) to be placed around the beverage container, to providing insulating stands upon which the container rests (e.g. U.S. Pat. No. 5,207,076).

Many prior art concepts are not suitable for use with pitchers having side handles, and/or permit advertising on only one surface of a sleeve (and thus require the use of an additional set of insulating sleeves when a second advertising message is desired). Others do not connect the insulating sleeve to the pitcher (they provide no insulation when the pitcher is picked up to pour a beverage). Still others involve costly and complicated components, or require the use of a velcro attachment running through the handle taking up needed finger space, and pose a risk of theft or vandalism when used at bars. Others use sleeves that must be removed before the liquid can be properly poured.

Thus, it can be seen that a need exists for an improved insulating sleeve for a beverage pitcher.

SUMMARY OF THE INVENTION

The invention provides an insulating sleeve for a beverage pitcher. The pitcher is of the type having a handle projecting radially outward from its side. The sleeve has a jacket capable of assuming a position around the pitcher such that the Jacket assumes an essentially frustum shaped wall structure with an essentially frustum shaped bore therethrough for receiving a body portion of the pitcher. The bore is open at both its bottom and its top. There is an essentially vertically extending slot through the jacket wall structure for permitting the pitcher handle to pass through. Advertising is positioned on the jacket.

The jacket is made from an insulating material that can be stretched to permit the positioning of the jacket around the pitcher with the pitcher handle extending through the slot, the handle being 360° surrounded by the jacket at the slot, a top portion of the pitcher extending up above a top edge of the jacket, and a bottom end of the pitcher extending down below a bottom edge of the jacket.

The jacket has an inside wall adjacent the bore and an outside wall radially opposed therefrom, and preferably there is advertising on both of the walls and the jacket is designed so that it can be inside out reversed. When this reversal occurs, the jacket will still be a sleeve in accordance with the invention, but with the former outside wall now being the inside wall, and the former inside wall now being the outside wall. In this manner an ad message can be changed without the need for a second jacket.

In another aspect of the invention, the jacket is formed from a flat, essentially trapezoidal piece of material by causing opposed ends of the material to form a seam, with a middle portion of the seam being the open slot. The bottom end of the trapezoid is preferably at least half as long (but less than ninety-eight percent as long) as the top end of the trapezoid, and the jacket is made of a highly flexible multi-layer material which serves both an insulating function and the function of absorbing condensation.

The objects of the invention therefore include providing an insulating sleeve of the above kind:

(a) that can be manufactured inexpensively from few components;

(b) which is reversible so as to permit the use of at least two separate advertising messages;

(c) which tightly fits around a generally frustum shaped pitcher while permitting the pitcher's spout to extend up above and radially outward of the sleeve, permitting the pitcher handle to extend outward through the sleeve, and permitting the pitcher base to extend below the sleeve; and (d) which does not require the use of a separate refrigerant.

These and still other objects and advantages of the present invention will be discussed below with reference to the preferred embodiment of the invention. While the following description and drawings describe and depict an example of the invention, the example is not exhaustive of all forms in the invention. Therefore, reference should be made to the claims (which follow the description) for determining the full scope of the invention.

DETAILED DESCRIPTION OF THE PREFERRED EMBODIMENTS

Figure 1:
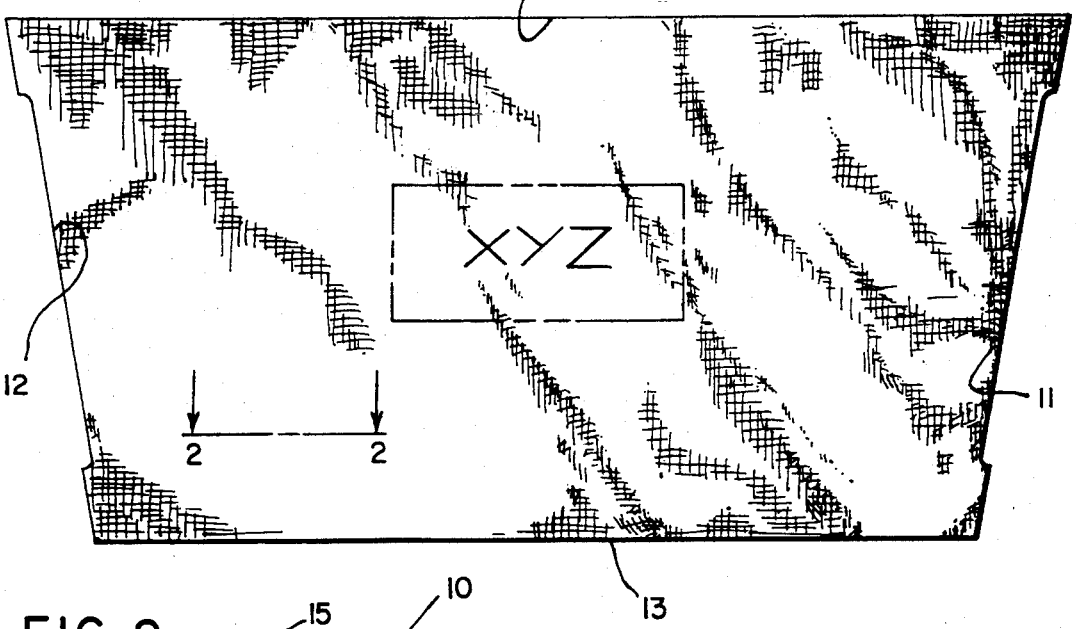
FIG. 1 is a side elevational view of a piece of insulating material before it forms the jacket of the present invention.

FIG. 1 shows a flat piece of essentially trapezoidal insulating material 10 having opposed side ends 11 and 12, an upper end 14, and a lower end 13. End 14 is about fifteen inches while end 13 is about eleven inches. The height of the material is about seven and a half inches. These are the preferred measurements when the sleeve is not mounted on a pitcher. In the alternative, end 13 is preferably between about fifty percent of the length of end 14 and ninety-eight percent of the length of end 14.

Figure 2:
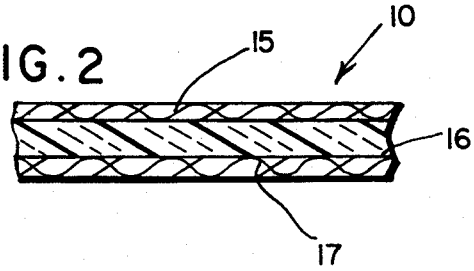
FIG. 2 is a partial cross sectional view taken on line 2—2 of FIG. 1.

As best seen in FIG. 2, the material 10 is a three layer sandwich. Exterior layers 15 and 17 are a nylon fabric that has been imbedded on a 3 mm thick neoprene layer 16. Various other insulating materials of single layer or multi-layer construction can also be used. However, the material should be sufficiently flexible so as to permit stretching when the sleeve is pulled onto the pitcher.

Figure 3:
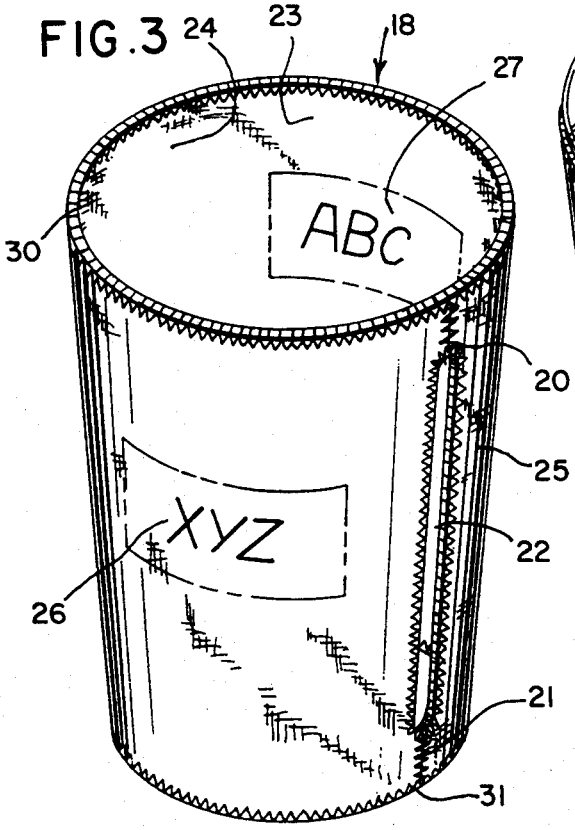
FIG. 3 is a perspective view of a preferred jacket of the present invention.

Turning now to FIG. 3, jacket 18 can be formed by having opposed ends 11 and 12 form a seam. One stitches (or otherwise connects) portions 20 and 21 (the upper and lower portions of the seam) together, but leaves the middle portion 22 open so as to define the slot. For reinforcement, the upper and lower edges of the slot can be double stitched.

Jacket 18 has an inside wall 23 adjacent bore 24, and an outside wall 25 radially opposed therefrom. Advertising messages 26 and 27 can be positioned on both walls. The jacket is generally frustum shaped when on the pitcher 32. The bore 24 is open at both its top 30 and bottom 31.

Even after the jacket 18 has been formed, it can be pulled upward over the lower end of pitcher 32 much as a girdle can be pulled up onto a human torso. If desired, prior to such an installation the lower end 31 can be pushed through the upper end 30 so as to reverse the jacket to an inside out position (see FIG. 4).

Figure 4:
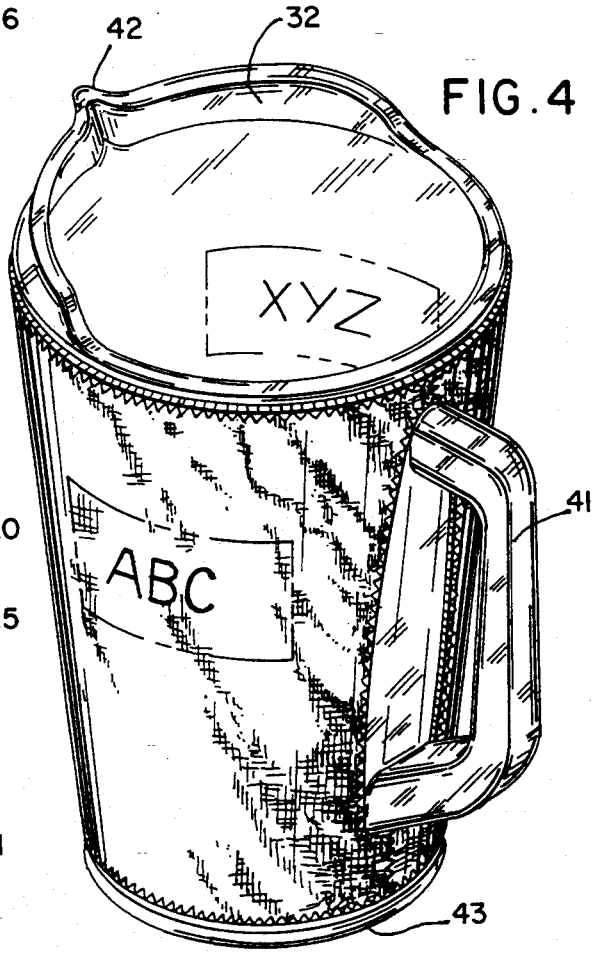
FIG. 4 is a perspective view showing the jacket reversed from the FIG. 3 configuration and then placed on a pitcher.

Regardless of whether the jacket is in the FIG. 3 configuration or the FIG. 4 configuration, it can then be pulled onto pitcher 32, notwithstanding handle 41, spout 42, and base 43.

It is desirable to have the spout of the pitcher extend beyond and above the edge 30 of the jacket so that the liquid being poured does not contact the sleeve. Further, it is desirable to truncate the bottom edge of the sleeve above the base of the pitcher so that the base does not sit on "squishy" material.

When positioning the jacket 18 on the pitcher 32, one preferably pulls the material outward at the upper end 30 so that seam part 20 can pass outward and upward along the outer periphery of handle 41. The resiliency of the material should be such that after this has occurred portion 20 then snaps tightly against the pitcher 32.

When the jacket is installed, advertising material can be visible on both walls, simultaneously. Note that "ABC" can also be seen in FIG. 4 even though being on what is now the inside surface due to the transparent nature of the pitcher and the positioning of the advertisement.

If desired, one can also provide stitching along the top wall 14 and bottom wall 13 so as to minimize the likelihood that the layers 15–17 will peel off during use. Also, while the primary intended uses are in connection with pitchers of malt beverage advertising, the term "advertising" should be given its broadest scope to cover any type of informational message as well.

As one alternative use of the invention, trivia questions can be placed on the outside of the sleeve with the answers being placed on the inside. In the alternative, two different beverages Can be advertised. Depending on the product being served, the sleeve can be adjusted for proper identification.

It will be therefore be appreciated that the present invention provides a means of insulating a pitcher having a handle. The sleeve serves multiple purposes, is inexpensively manufactured, and does not suffer various drawbacks that are present with other existing sleeves.

We claim:

1. An insulating sleeve for a beverage pitcher, wherein the pitcher is of the type having a handle projecting radially outward from its side, the sleeve comprising:

a jacket capable of assuming a position around the pitcher such that the sleeve has an essentially frustum shaped wall structure with an essentially frustum shaped bore therethrough for receiving a body portion of the pitcher, the bore being open at its bottom and at its top;

an essentially vertically extending slot through the jacket wall structure for permitting the pitcher handle to pass through;

wherein the jacket has an inside wall adjacent the bore, an outside wall radially opposed therefrom, and advertising positioned on both the inside and outside walls; and wherein the sleeve is made from an insulating material and the jacket is configured such that the jacket can be stretched to permit the tight positioning of the jacket around the pitcher while allowing: the pitcher handle to be extended through the slot, the handle to be 360° surrounded by the sleeve at the slot, a top portion of the pitcher to be extended above a top edge of the sleeve, and a bottom end of the pitcher to be extended below a bottom edge of the sleeve, when the jacket is positioned on the pitcher.

2. The sleeve of claim 1, wherein the jacket comprises a flexible material such that it can be inside out reversed, and so that when this reversal occurs the jacket will still be a sleeve in accordance with claim 1, but with the former inside wall now being the outside wall and the former outside wall now being the inside wall.

3. An insulating sleeve for a beverage pitcher, wherein the pitcher is of the type having a handle projecting radially outward from its side, the sleeve comprising:

a jacket capable of assuming a position around the pitcher such that the sleeve has an essentially frustum shaped wall structure with an essentially frustum shaped bore therethrough for receiving a body portion of the pitcher, the bore being open at its bottom and at its top;

an essentially vertically extending slot through the jacket wall structure for permitting the pitcher handle to pass through;

wherein advertising is positioned on the jacket;

wherein the sleeve is made from an insulating material and the jacket is configured such that the jacket can be stretched to permit the tight positioning of the jacket around the pitcher while allowing: the pitcher handle to be extended through the slot, the handle to be 360° surrounded by the sleeve at the slot, a top portion of the pitcher to be extended above a top edge of the sleeve, and a bottom end of the pitcher to be extended below a bottom edge of the sleeve, when the jacket is positioned on the pitcher;

wherein the jacket comprises a flat, essentially trapezoidal piece of material having opposed ends which are joined to form a seam, albeit with a middle portion of the seam being the slot; and wherein the essentially trapezoidal piece of material is a multi-layer material with an insulation layer and at least one decorative outer layer.

* * * * *